US006297434B1

(12) United States Patent
Martello

(10) Patent No.: US 6,297,434 B1
(45) Date of Patent: Oct. 2, 2001

(54) WEDGE ADJUSTABLE BRIDGE FOR STRINGED INSTRUMENTS

(76) Inventor: Jose Mario Martello, 335 Thistle Cir., Martinez, CA (US) 94553

( * ) Notice: Subject to any disclaimer, the term of this patent is extended or adjusted under 35 U.S.C. 154(b) by 0 days.

(21) Appl. No.: 09/636,233

(22) Filed: Aug. 10, 2000

Related U.S. Application Data

(60) Provisional application No. 60/148,465, filed on Aug. 11, 1999.

(51) Int. Cl.[7] ..... G10D 3/04

(52) U.S. Cl. ..... 84/298; 84/299; 84/307; 84/290; 84/312 R

(58) Field of Search ..... 84/298, 299, 307, 84/312 R, 290

(56) References Cited

U.S. PATENT DOCUMENTS 536,846 * 4/1895 Bates ..... 84/298
3,910,152 * 10/1975 Kusakawa ..... 84/307
4,311,078 * 1/1982 Falgares ..... 84/314 R
5,750,910 * 5/1998 LoJacono ..... 84/314 N
6,031,165 * 2/2000 Brekke ..... 84/298

OTHER PUBLICATIONS

Catalog—Stewart & McDonald, Summer 1999, p. 68, discloses a series of adjustable bridges in column 3.

* cited by examiner

*Primary Examiner*—Shih-Yung Hsieh
(74) *Attorney, Agent, or Firm*—Richard Esty Peterson Patent Attorney

(57) ABSTRACT

An adjustable bridge for stringed instruments that utilizes a wedge mechanism seated on a base that in turn is seated on the top surface of a stringed instrument, with the wedge mechanism supporting a saddle member engaged by the strings of the stringed instrument. The wedge mechanism having an adjustment screw for displacing a pair of wedge members which raise and lower the saddle member.

20 Claims, 2 Drawing Sheets

WEDGE ADJUSTABLE BRIDGE FOR STRINGED INSTRUMENTS

This application claims the benefit of provisional application Ser. No. 60/148,465, filed Aug. 11, 1999.

BACKGROUND OF THE INVENTION

This invention relates to an adjustment mechanism for the bridge of a stringed instrument. The adjustment mechanism comprises a wedge adjustable bridge that is particularly adapted for use on archtop guitars, mandolins and other stringed instruments where adjustment to the height of the bridge is advantageous to improve the sound or feel of the instrument.

Adjustment mechanisms for raising and lowering the height of the bridge of stringed instruments have been available. A common device utilizes a pair of thumbwheel posts at each end of a bridge that interconnect a displaceable string saddle from a base. On turning the thumbwheel posts, the saddle is raised or lowered relative to the base which seats on the face of the instrument,. The quality of the tone of the instrument can be affected by the use of metal thumbwheel posts. It is an object of this invention to provide an improved adjustable bridge that has the characteristics of a solid one-piece bridge.

SUMMARY OF THE INVENTION

The adjustable bridge of this invention is both structurally sound and visually attractive. The invented bridge appears and performs like a solid bridge. The adjustable bridge utilizes a dual wedge mechanism to raise and lower a string saddle member seated on the wedge mechanism while the wedge mechanism seats on a base. The force of the strings are not focussed at spaced posts as in the conventional thumbwheel post system but are distributed across two elongated wedge members that support the saddle on the base.

The two elongated wedge members are slidably supported on the base and support a triangular-shaped saddle member in the cradle formed by the oppositely positioned wedge members. The two oppositely positioned wedge members are interconnected by an elongated machine screw that inserts through the wedge members and through a locator pin projecting from the base. A pair of spring elements on each side of the locator pin maintain the separation of the wedge members until drawn together by the elongated machine screw. The triangular-shaped saddle member is seated on the wedge members on a projecting portion of the locator pin to maintain its central position relative to the base.

On turning the elongated machine screw at one end of one of the wedge members the interconnected wedge members are drawn together or spread apart depending on the angular direction that the screw is turned. The seated saddle member has an incline, v-shaped underside complimentary to the incline of the wedge members. On the separation or the drawing together of the two wedge members, the saddle is correspondingly lowered or raised.

In an alternate embodiment, the interconnection element comprises a double ended adjustment screw with a left handed thread at one end segment and a right handed thread at the opposite end segment. Each wedge member has an internal thread preferably a threaded metal insert, with a thread direction matching the engaged threaded end segments of the adjustment screw.

The wedge adjustable bridge of this invention can be adapted to a variety of acoustic or electric stringed instruments. It is particularly adapted for use on an archtop guitar and the preferred embodiment described herein is for an archtop acoustic guitar.

DETAILED DESCRIPTION OF THE PREFERRED EMBODIMENT

Figure 1:
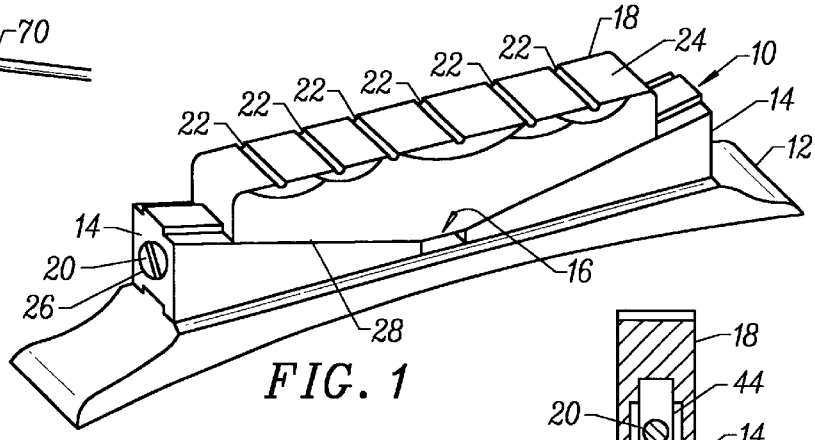
FIG. 1 is a perspective view of the invented wedge adjustable bridge for stringed instruments.

The wedge adjustable bridge of this invention is shown in the drawings and designated generally by the reference numeral 10. The wedge adjustable bridge has a base 12 which is seated on the top or face of a stringed instrument in conventional fashion. The base supports a pair of opposed wedge members 14 which in turn form a cradle 16 on which is supported a saddle member 18. At one end of the wedge members 14 is an adjustment screw 20. The saddle member 18 supports a series of parallel strings (not shown) in notches 22 across the top 24 of the saddle member 18. As shown in FIG. 1, the saddle member 18 may have a contoured top 24 to shift the relative position of the string contact as desired by the user or manufacturer.

To raise or lower the saddle member 18, the head 26 of the adjustment screw 20 is engaged by a screwdriver and turned either forward or at. Turning the screw forward draws the two wedge members 14 together causing the saddle member, which has a triangular configuration with an incline bottom edge 28, to rise. By turning the screw head in the opposite direction, the wedge members are drawn apart and the saddle member is lowered in the cradle 16. In this manner the effective height of the saddle member above the face of the stringed instrument is adjustable.

Figure 2:
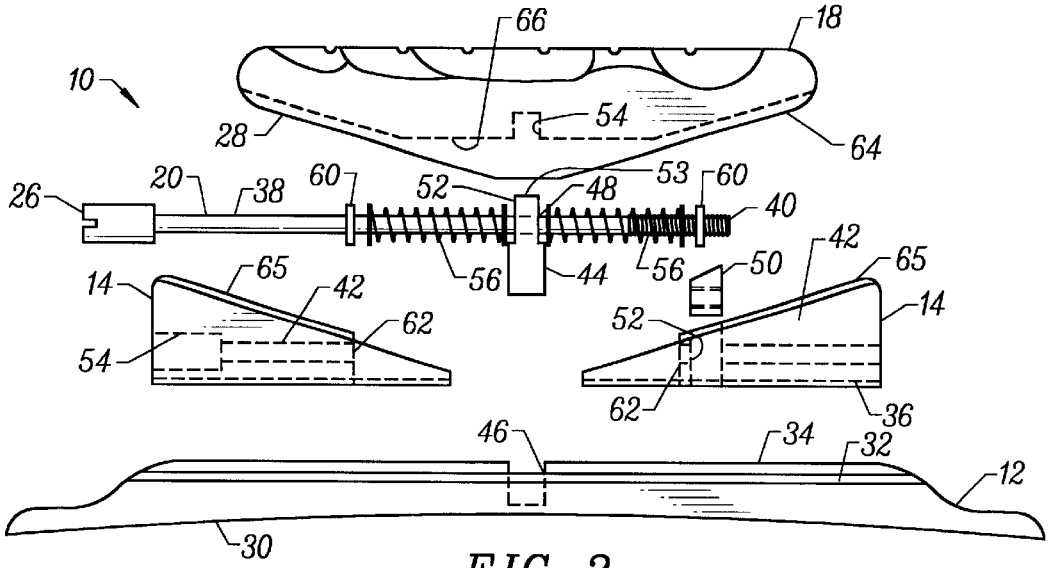
FIG. 2 is an exploded view of the elements and members forming the wedge adjustable bridge of FIG. 1.
Figure 4:
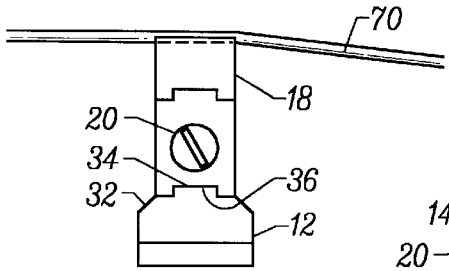
FIG. 4 is an end elevational view of the wedge adjustable bridge showing a typical partial string.
Figure 5:
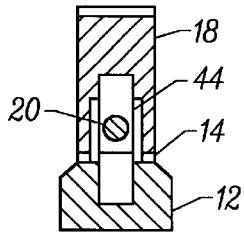
FIG. 5 is a cross-sectional view of the wedge adjustable bridge taken on the lines 5—5 in FIG. 3.

Referring to the exploded view of FIG. 2, the base 12 is shown with a curved underside 30 that seats on a complimentary curved or arched top of the instrument for which the bridge is designed. It is to be understood that the underside of the base can be flat when the adjustable bridge is used on a stringed instrument that has a flat top where raising or lowering of the bridge is desired for such instruments. The base 12 has a bevel 32 along its upper edge with a raised track 34 that is engageable by the grooved underside 36 of the wedge members 14. This arrangement is readily apparent from the end view of FIG. 4. The wedge members 14 are seated on the track 34 of the base and slidable thereon. The two wedge members 14 are interconnected by the machine screw 20 that has a smooth neck portion 38 and a threaded end portion 40. The elongated adjustment screw 20 interconnects the two wedge members 14 by threading through a passage 42 in each wedge member (shown in dotted line) and through a locator pin 44. The locator pin 44 seats in a recess 46 in the base 12 of the adjustable bridge 10 and it includes a hole 48 through which the adjustment screw passes. The threaded end 40 of the adjustment screw 20 engages a threaded insert 50 which seats in the wedge member 14 opposite the wedge member having the inset 54 for the screw head 26. The locator pin 44 has a flattened portion 52 with an extension 53 that seats in an inset 54 in the saddle member 18 to retain the saddle member 18 in a centrally located position on the base 12. The inset 54 accommodates the extension 53 of the locator pin 44 when the saddle member 18 is raised and lowered. On each side of the flattened portion 52 of the locator pin 44 are compression springs 56 that are trapped on the adjustment screw between the locator pin 44 and washers 60 that seat against a seating face 62 in the wedge members 14. The saddle member 18 has a grooved, inclined underside 64 that engages the top track edge 65 of the wedge members 14. To accommodate the adjustment screw 20 the saddle member 18 has an internal channel 66 shown in dotted line in FIG. 2. As shown in FIG. 5, the assembly of the saddle member 18 and the base 12 is aligned by the locator pin 44.

Figure 3:
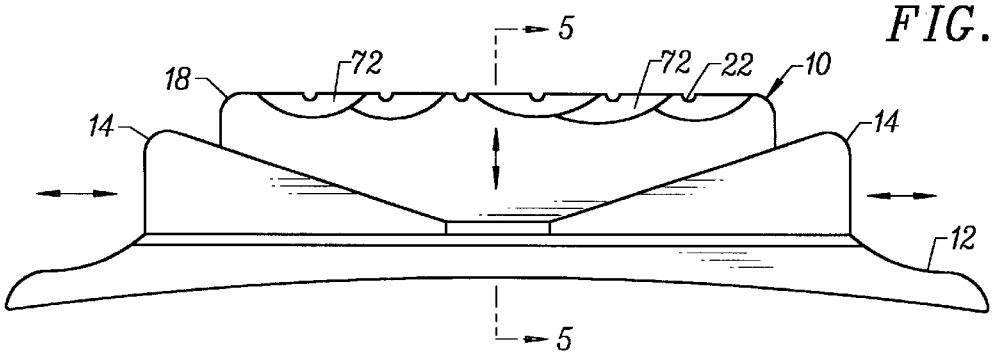
FIG. 3 is a side, elevational view of the wedge adjustable bridge.

As shown by the arrow notations in FIG. 3, displacement of the two wedge members 14 in a horizontal direction will result in the vertical displacement of the saddle member 18. This displacement results by turning the adjustment screw 20 to draw together or spread apart the wedge members 14. The assembly of the wedge adjustable bridge 10 is maintained by the force of the instruments strings 70 that are maintained in tension, one of which is shown in FIG. 4.

It is to be understood that the basic wedge adjustable bridge can be constructed using different sized components and using different actuating mechanisms. As shown in FIG. 3, the wedge adjustable bridge utilizes a tongue and groove configuration to unite four primary elements into a composite that is similar to a solid bridge. The complimentary seating of each member against the other provides distribution of the spring forces across the entire saddle member which is transmitted to the two wedge members and finally to the elongated base. As shown in the figures, the saddle member 18 can include custom shaping 72 as desired by the manufacturer or user to achieve the precise tuning desired. Additionally, the four primary elements can be fabricated from hardwood or a hard plastic and formed by matching or molding with modifications in the configuration of the parts to accommodate different instruments.

Figure 6:
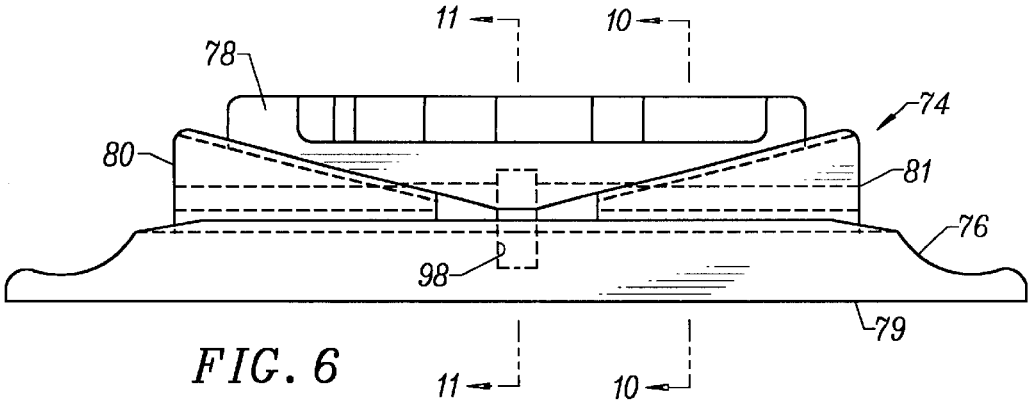
FIG. 6 is a side elevational view of a second embodiment of an adjustable bridge.

Referring now to FIG. 6, an alternate embodiment 74 of the wedge adjustable bridge is shown. The wedge adjustable bridge 74 includes a base 76 and a saddle member 78 that are similar in design and function to those elements recited for the first embodiment 10. The base 76 has a flat underside 79 and is designed for a stringed instrument having a flat top surface. On the base 76 are supported a pair of wedge members 80 and 81 that are similar in construction to the wedge members 14 of the previous embodiment 10.

Figure 7:
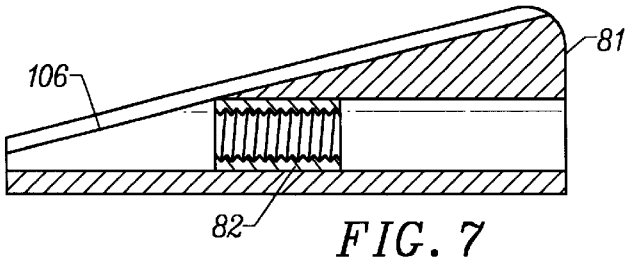
FIG. 7 is a cross-sectional view of one of the wedge members of the adjustable bridge of FIG. 6.
Figure 11:
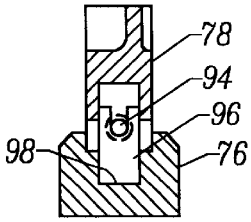
FIG. 11 is a cross-sectional view taken on the lines 11—11 in FIG. 6.
Figure 9A:
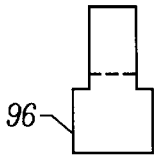
FIG. 9A is a side elevational view of a locator pin in the adjustable bridge of FIG. 6.
Figure 9B:
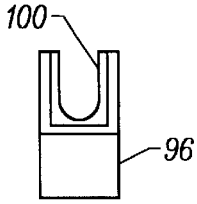
FIG. 9B is an end view of the locator pin of FIG. 9A.
Figure 8:
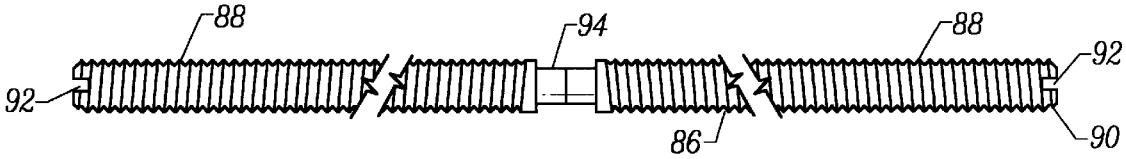
FIG. 8 is a side view of an adjustment screw in the adjustable bridge of FIG. 6.

As shown in the cross-sectional view of FIG. 7, the wedge member 81 includes a threaded insert 82. The wedge members 80 and 81 are mirror configurations with the inserts having opposite threading. In this manner, an elongated adjustment screw 86, shown in FIG. 8, engages each of the wedge members 80 and 81 through correspondingly opposite threaded end segments 88 of the adjustment screw 86. The oppositely threaded end segments 88 of the adjustment screw 86 thread into the appropriately threaded inset and cause the opposed wedge members 80 and 81 to separate or come together when the adjustment screw is turned. To facilitate turning of the adjustment screw, the adjustment screw 86 has ends 90 with screw driver slots 92. To maintain the position of the adjustment screw, the screw 86 includes a central constricted segment 94 which engages a locator pin 96 that is shown in FIG. 9A and FIG. 9B. The locator pin 96 seats in a recess 98 in the base 76 as shown in dotted line in FIG. 6 and in the cross-sectional view of FIG. 11. The locator pin 96 has a u-shaped yoke portion 100, shown in FIG. 9B, that engages the constricted segment 94 of the adjustment screw 86 to retain the position of the adjustment screw relative to the base without inhibiting the rotation of the adjustment screw when it is turned to spread or contract the wedge members 80 and 81.

In operation, the assembly of FIG. 6 operates similar to that of FIG. 3. However, fewer parts are required and the adjustment screw can be adjusted from either end using the screw drive slots. The assembly as shown in the cross-sectional view of FIG. 10 is held together by the force of the strings 70, one of which is shown, when the wedge adjustable bridge is in use.

Figure 10:
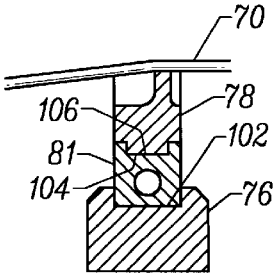
FIG. 10 is a cross-sectional view taken on the lines 10—10 in FIG. 6.

As shown in FIG. 10, the assembly of the alternate embodiment 74 is modified slightly from the embodiment 10 of FIG. 1. The base 76 has a groove or channel 102 the width of the wedge members 80 and 81. The wedge members 80 and 81 seat in the channel 102 and are displaceable on the base 76 on turning of the adjustment screw 86. A tongue 104 on the underside of the saddle member 76 engages a groove 106 on the sloped top of the wedge members 80 and 81 in a manner similar to that of the first embodiment. In operation, the two embodiments operate in substantially the same manner, wherein on turning the adjustment screw in one direction the wedge members are drawn together and the saddle member is raised relative to the base, and, on turning the adjustment screw in the opposite direction the wedge members are further separated and the saddle member is lowered relative to the base.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An adjustable bridge for stringed instruments comprising:

a base having an underside adaptable for seating on a top surface of a stringed instrument, a pair of opposed wedge members displaceably supported on the base and arranged to form a cradle;

a saddle member having substantially triangular configuration with a top constructed to support strings of a stringed instrument, and an underside that engages the wedge members in use; and an adjustment mechanism engaging the opposed wedge members wherein on adjustment of the adjustment mechanism the wedge members are selectively drawn together or further separated, wherein the saddle member is respectively raised or lowered, wherein the adjustment mechanism comprises an elongated adjustment screw with opposite end segments having opposed threading, and threaded inserts in the wedge members with threads that conform with the oppositely threaded end segments of the elongated adjustment screw.

2. The adjustable bridge of claim 1 wherein the base and wedge members have tracking means for guided displacement of the wedge members when displaced by the adjustment mechanism.

3. The adjustable bridge of claim 2 wherein the tracking means comprises a tongue and groove interconnection.

4. The adjustable bridge of claim 2 wherein the tracking means comprises a groove in the base, wherein the wedge members are seated in the groove in the base.

5. The adjustable bridge of claim 1 wherein the wedge members and saddle member have tracking means for guided displacement of the wedge members and saddle member when displaced by the adjustment mechanism.

6. The adjustable bridge of claim 5 wherein the tracking means of the wedge members and saddle member comprise a tongue and groove interconnection.

7. The adjustable bridge of claim 5 wherein the saddle member has a contoured top which engages strings of a stringed instrument.

8. The adjustable bridge of claim 1 wherein the adjustment mechanism comprises an elongated adjustment screw.

9. The adjustable bridge of claim 1 including a locator pin positioning the vertically displaceable saddle on the base.

10. The adjustable bridge of claim 9 wherein the locator pin includes a yoke, and wherein the adjustment mechanism includes an elongated adjustment screw with a constricted central segment engageable with the yoke of the locator pin.

11. An adjustable bridge for stringed instruments comprising:

a base having an underside adaptable for seating on a top surface of a stringed instrument, a pair of opposed wedge members displaceably supported on the base and arranged to form a cradle;

a saddle member having substantially triangular configuration with a top constructed to support strings of a stringed instrument, and an underside that engages the wedge members in use;

an adjustment mechanism engaging the opposed wedge members wherein on adjustment of the adjustment mechanism the wedge members are selectively drawn together or further separated, wherein the saddle member is respectively raised or lowered; and a locator pin positioning the vertically displaceable saddle on the base.

12. The adjustable bridge of claim 11 wherein the base and wedge members have tracking means for guided displacement of the wedge members when displaced by the adjustment mechanism.

13. The adjustable bridge of claim 12 wherein the tracking means comprises a groove in the base, wherein the wedge members are seated in the groove in the base.

14. The adjustable bridge of claim 12 wherein the tracking means comprises a tongue and groove interconnection.

15. The adjustable bridge of claim 11 wherein the wedge members and saddle member have tracking means for guided displacement of the wedge members and tracking member when displaced by the adjustment mechanism.

16. The adjustable bridge of claim 15 wherein the tracking means of the wedge members and saddle member comprise a tongue and groove interconnection.

17. The adjustable bridge of claim 15 wherein the base has a contoured top which engages strings of a stringed instrument.

18. The adjustable bridge of claim 11 wherein the adjustment mechanism comprises an elongated adjustment screw.

19. The adjustable bridge of claim 11 wherein the adjustment mechanism comprises an elongated adjustment screw with opposite end segments having opposite threading, and threaded inserts in the wedge members with threads adapted to the oppositely threaded end segments of the elongated adjustment screw.

20. The adjustable bridge of claim 11 wherein the locator pin includes a yoke, and wherein the adjustment mechanism includes an elongated adjustment screw with a constricted central segment engageable with the yoke of the locator pin.

* * * * *